US005999757A

United States Patent [19]

Shimomura et al.

[11] Patent Number: 5,999,757

[45] Date of Patent: Dec. 7, 1999

[54] SHEET TRANSPORTATION DEVICE

[75] Inventors: Yoshiki Shimomura; Sadao Tanigawa; Kazuhiro Ogawa; Hirofumi Nishino; Kenji Katsuhara, all of Osaka, Japan

[73] Assignee: Mita Industrial Co., Ltd., Osaka, Japan

[21] Appl. No.: 08/856,806

[22] Filed: May 15, 1997

[30] Foreign Application Priority Data

May 21, 1996 [JP] Japan ..... 8-126160

[51] Int. Cl.[6] ..... G03G 15/00

[52] U.S. Cl. ..... 399/9; 399/16; 399/18

[58] Field of Search ..... 399/18, 9, 16; 271/3.01, 3.14, 9.01

[56] References Cited

U.S. PATENT DOCUMENTS 5,239,547 8/1993 Tomiyama et al. ..... 399/9 X

FOREIGN PATENT DOCUMENTS 4-130331 5/1992 Japan .

*Primary Examiner*—Arthur T. Grimley
*Assistant Examiner*—Hoan Tran
*Attorney, Agent, or Firm*—Beveridge, Degrandi, Weilacher & Young, LLP

[57] ABSTRACT

A sheet transportation device for use in an image forming apparatus is provided which has self-diagnosis and self-repair functions. The sheet transportation device has a sheet transportation system including a plurality of units (8). A control sequence for a sheet transportation operation is applied from a system body (10) to the respective units (8). The units (8) each execute the control sequence to perform the sheet transportation operation. The units (8) are each constructed so as to perform an autonomous operation. This construction allows the respective units to autonomously perform self-diagnosis and repair operations. The fault diagnosis and repair operations are performed in parallel to the sheet transportation control. Therefore, the sheet transportation device can flexibly adapt itself to an external influence such as a change in the use environment and a malfunction due to a time-related change such as the aging of components thereof. Thus, the sheet transportation device ensures a highly reliable operation and yet requires less labor for the maintenance and inspection.

6 Claims, 17 Drawing Sheets

FIG. 6

| Parameter | Operation | Time (ms) |
|---|---|---|
| ω motor 1 | up | 20 + 3 × X up |
| | down | 20 + 3 × X down |
| ω motor 2 | up | 30 + 3 × X up |
| | down | 30 + 3 × X down |
| ω motor 3 | up | 10 + 3 × X up |
| | down | 10 + 3 × X down |
| ω motor 4 | up | 20 + 3 × X up |
| | down | 20 + 3 × X down |
| clutch 1 | on | 16 |
| | off | 10 |
| clutch 2 | on | 16 |
| | off | 10 |

X : Number of times of operation (positive integer)

FIG. 7

| Parameter | Operation | Controllable range from zero control level |
|---|---|---|
| ω motor 1 | up | 127 |
| | down | 127 |
| ω motor 2 | up | 127 |
| | down | 127 |
| ω motor 3 | up | 40 |
| | down | 10 |
| ω motor 4 | up | 800 |
| | down | 1200 |
| clutch 1 | on | |
| | off | |
| clutch 2 | on | |
| | off | |

FIG. 8

| Paper State | Parameter State |
|---|---|
| FREE | Pd = 0 |
| F_DRIVE | Pd > 0, Vf > 0 |
| FIX | Pd > 0, Vf = 0 |
| B_DRIVE | Pd > 0, Vf < 0 |

SHEET TRANSPORTATION DEVICE

This application is based on an application No. 8-126160 filed in Japan, the content of which is incorporated hereinto by reference.

BACKGROUND OF THE INVENTION

1. Field of the Invention

The present invention relates to a sheet transportation device for an image forming apparatus and, more particularly, to a sheet transportation device having functions of performing self-diagnostics on sheet-feeding and transporting operations and self-repairing a fault.

2. Description of the Related Art

In the field of image forming apparatuses such as copying machines, a research and development has recently been conducted on self-diagnosis and self-repair functions utilizing artificial intelligence (AI) for maintenance automation.

The applicant of the present invention previously proposed a system for ensuring formation of a high quality image and, if the image quality is deteriorated, performing self-diagnosis and self-repair operations (for example, see Japanese Unexamined Patent Publication No. 4-130331 (1992)).

In terms of the maintenance of the overall image forming apparatus, however, the prior art is not satisfactory which deals only with the image quality maintenance of formed images. Therefore, it is desirable to cover a wider range of objective functions for maintenance thereof.

In recent years, a need has arisen for sequentially feeding a multiplicity of sheets for the speeding up of the operation of a copying machine. The sequential feeding of the multiplicity of sheets essentially requires improvement of the performance and stability of a sheet transportation system of the copying machine.

Unfortunately, most of presently available sheet transportation systems or mechanisms can use only limited types of sheets made of specific materials, and can be used only in a specific operational environment because of their performance unstableness toward a change in the operational environment.

The sheet transportation system per se deteriorates with time due to the aging of components thereof, thereby often causing a sheet feeding failure (e.g., plural-sheet feeding, no-sheet feeding and sheet jam). When such a failure occurs, a typical approach to the functional maintenance of the system is the cleaning of the system or the replacement of a faulty component.

SUMMARY OF THE INVENTION

In view of the foregoing, it is an object of the present invention to provide a system, which is adapted to perform self-diagnostics on sheet-feeding and sheet-transporting operations in a sheet transportation device and take preventive measures and countermeasures against faults resulting from an external interference such as a change in a sheet material, a use environment or the like or a time-related change of the device for maintenance of the device.

It is a more specific object of the invention to provide a sheet transportation device for performing a self-repairing operation for functional maintenance of a sheet transportation system.

In accordance with a first aspect of the present invention, there is provided a sheet transportation device having a sheet transportation system constituted by a plurality of units, the plurality of units each comprising: a plurality of components including an actuator and an action device to be actuated or brought in a varied state by the actuator; a sensor for sensing a state of a predetermined component; knowledge storage means storing therein knowledge information on a parameter model in which the components are represented on the basis of cause-effect relations between physical parameters thereof and knowledge information on operation of a predetermined actuator; sequence execution means for executing a control sequence to perform a sheet transportation operation in association with the other units of the sheet transportation system; means for monitoring an output of the sensor and judging a fault on the basis of the output of the sensor; and self-diagnosis and repair means for determining a cause of the fault and formulating a repair plan on the basis of the knowledge information stored in the knowledge storage means in response to the judgment of the fault, and autonomously performing a fault repairing operation in the unit independently of the other units.

In accordance with a second aspect of the invention, the repairing operation to be performed by the self-diagnosis and repair means in the sheet transportation device includes a controllable self-repairing operation in which a parameter related to a function damaged by the fault is retrieved from the parameter model knowledge information and an actuator required for changing the value of the parameter is selected, whereby the repairing operation is achieved by controlling the actuator without reconstruction or reconfiguration of the components.

In accordance with a third aspect of the invention, the sheet transportation device further includes a system body, which comprises: a sequence formulation section for formulating a control sequence for the overall sheet transportation system; a simulation section for simulating the behavior of a sheet on the basis of the formulated control sequence; and an evaluation section for evaluating a simulation result obtained in the simulation section; wherein, if the control sequence provides an acceptable simulation result, the control sequence is applied to the respective units.

In accordance with a fourth aspect of the invention, the control sequence generated by and applied from the system body is segmented for each unit, and the resulting control sequence segments are applied to the respective units.

In accordance with a fifth aspect of the invention, the units each further include translation means for translating the applied control sequence into a unit-executable quantitative sequence on the basis of the knowledge information stored in the knowledge storage means.

With the arrangement according to the first aspect of the present invention, the units constituting the sheet transportation system respectively operate to achieve the sheet transportation in association with each other. For example, the units are controlled so as to keep a sheet transportation speed at 400 mm/s. At the same time, the units each perform a self-diagnosis to check if a particular fault occurs therein. If a particular fault (e.g., biased sheet transportation, no-sheet feeding or plural-sheet feeding) occurs, the units autonomously self-repair the fault.

The self-diagnosis and self-repair operation includes the controllable self-repairing operation in accordance with the second aspect. In the controllable self-repairing operation, a parameter related to a function damaged by a fault is retrieved, and an actuator is operated to change the value of the parameter.

If the sheet transportation speed becomes lower, for example, an actuator operation is performed so as to increase the rotation speed of the motor.

Thus, the unit is restored to its normal operation state by the self-diagnosis and self-repair operation so that the sheet transportation system can maintain a proper operation as a whole.

Where the sheet transportation device incorporates the system body, the system body generates a control sequence for controlling the overall operation of the sheet transportation system in accordance with the third aspect of the invention.

The generated control sequence is segmented for each unit and the resulting control sequence segments are applied to the respective units in accordance with the fourth aspect of the invention.

The control sequence to be applied to the respective units is a versatile control sequence which is generated by the system body. Therefore, the units each translate the applied versatile control sequence into a unit-executable sequence on the basis of the unit-specific knowledge information in accordance with the fifth aspect of the invention.

Briefly, the versatile control sequence for the overall sheet transportation system is generated by the system body, and the units each translate the control sequence to perform a control operation. Therefore, even if the conditions of the device are changed due to replacement of any of the units or a changed in the ability of any of the units, the device can flexibly adapt itself to the change in the conditions.

The foregoing and other objects, features and effects of the present invention will become more apparent from the following description of the preferred embodiments with reference to the attached drawings.

BRIEF DESCRIPTION OF THE DRAWINGS

FIG. 6 is an exemplary list of actuator operation times which are part of knowledge information for a self-repairing operation in the sheet supply unit;

FIG. 7 is an exemplary list of controllable ranges of the actuators;

FIG. 8 is a table illustrating the relationship between the state of a sheet and the state of an actuator;

DESCRIPTION OF THE PREFERRED EMBODIMENTS

1. Construction of Device

Figure 1:
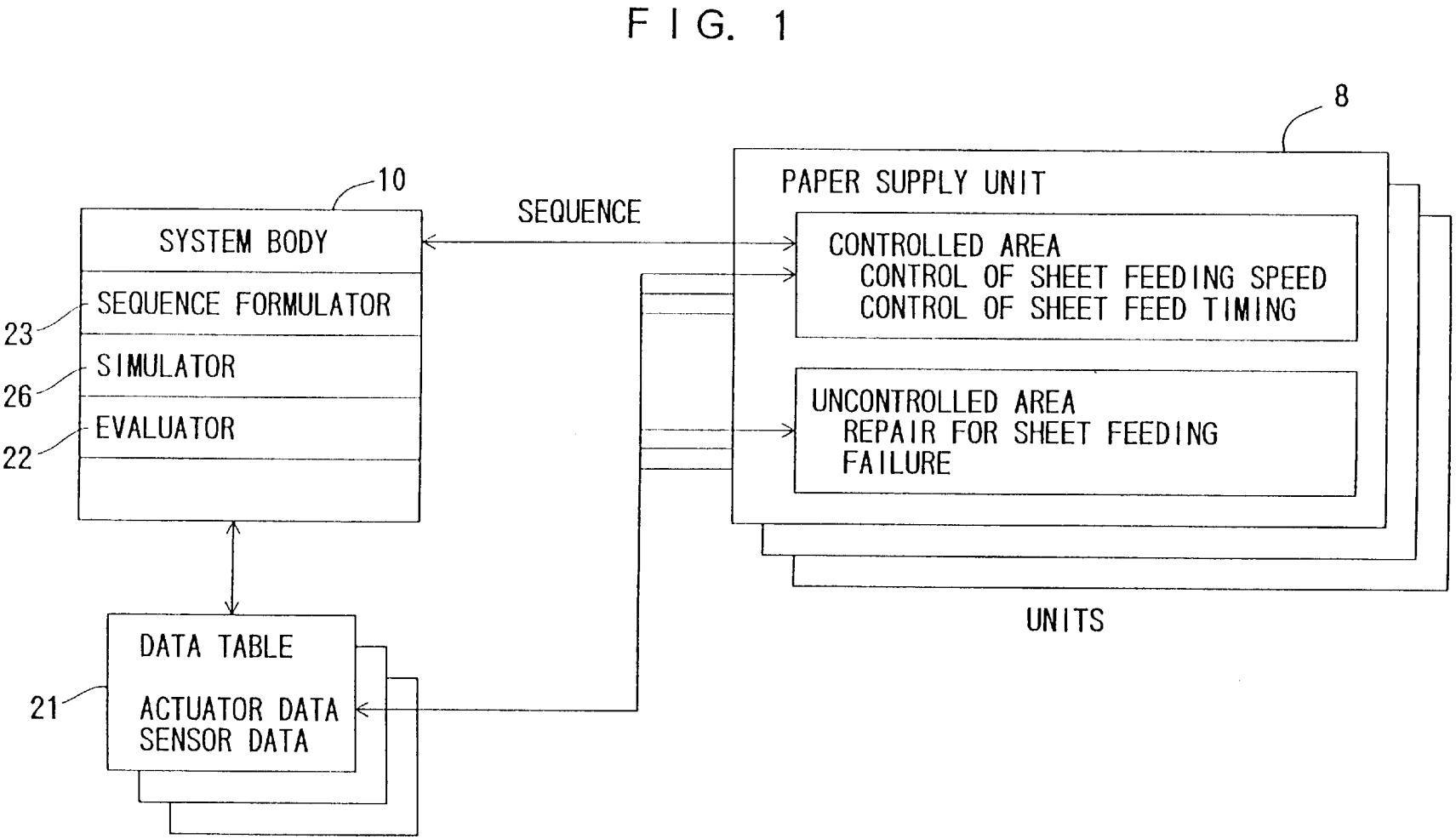
FIG. 1 is a diagram schematically illustrating the construction of a sheet transportation device according to one embodiment of the present invention.

FIG. 1 is a diagram schematically illustrating the construction of a sheet transportation device. The sheet transportation device includes a system body 10, a plurality of units 8 and a plurality of data tables 21 provided in correspondence with the respective units.

The system body 10 includes control sequence formulation section 23 for formulating a control sequence, a simulation section 26 for simulating the behavior of a sheet on the basis of the formulated control sequence, and an evaluation section 22 for evaluating a simulation result obtained in the simulation section 26. If the simulation result of the control sequence formulated in the system body 10 is acceptable, the control sequence is applied to the units 8. At this time, the control sequence generated in the system body 10 is segmented for each unit, and the resulting control sequence segments are respectively applied to the corresponding units 8.

The units 8 include a sheet supply unit for performing a sheet feeding operation, a sheet transportation unit for performing a transportation operation, and a sheet discharge unit for discharging a transported sheet into a predetermined place.

In the present invention, the sheet transportation system is not constructed as an integral hardware component adapted for sheet feeding, sheet transportation and sheet discharging, but is divided into a plurality of smaller units which constitute the sheet transportation system on a hardware basis. The units each have a construction adapted for an autonomous operation, which will be described later. Thus, the units are each capable of performing a self-repairing operation, so that the device can flexibly deal with a fault.

An explanation will next be given to the units 8, taking the sheet supply unit as an example. The sheet supply unit 8 includes a controlled area which is controlled by the system body 10 and an uncontrolled area which is not directly controlled by the system body 10 but performs an autonomous unit controlling operation.

In the controlled area, the circumferential speed of a sheet feeding roller (sheet feeding speed) and the timing of sheet feeding are controlled. The control operations are performed on the basis of the control sequence generated in the system body 10. Further, when the sheet feeding speed changes due to the aging of the sheet supply unit 8, the sheet feeding speed is kept at a predetermined level by a controllable self-repairing technique which will be described later.

In the uncontrolled area, a repairing operation for a sheet feeding failure such as plural-sheet feeding or no-sheet feeding is autonomously performed. The autonomous operation does not mean that the operation is independently performed on a hardware basis, but herein means that actuators in the unit are selectively operated on the basis of a parameter model specific to the sheet supply unit 8 by the controllable self-repair technique.

The controlled area and the uncontrolled area are embodied by a small-scale computer such as a microprocessor.

Though not shown, the units 8 each include rollers for applying a transportation force to a sheet, a motor for rotating the rollers, and a clutch for selectively applying the driving force of the motor to the rollers. That is, the units 8 each have a plurality of components including actuators such as a motor and a solenoid and action devices linked to the actuators (devices such as a clutch and rollers to be actuated or brought in a varied state by the actuators). Further, the units 8 each have a plurality of sensors for sensing the states of predetermined components including the rotational state of the rollers, an urging force applied to a sheet by the rollers, the rotational speed and direction of the motor.

The units 8 each have a knowledge memory which stores therein unit-specific knowledge information such as a parameter model and knowledge information for actuator operation (which will be described later).

The data tables 21 are used in common by the units 8 and the system body 10. The data tables 21 each retain actuator information and sensor information for the corresponding unit 8. The actuator information and the sensor information are rewritten and updated on the basis of outputs from the sensors of the units 8. Although the data tables 21 are provided outside the system body 10 in FIG. 1, they may be incorporated in the system body 10.

The knowledge memory storing therein the parameter model for the unit 8 and the knowledge information for the actuator operation may be provided in the data table 21.

2. Flow of Operation of Device

Figure 2:
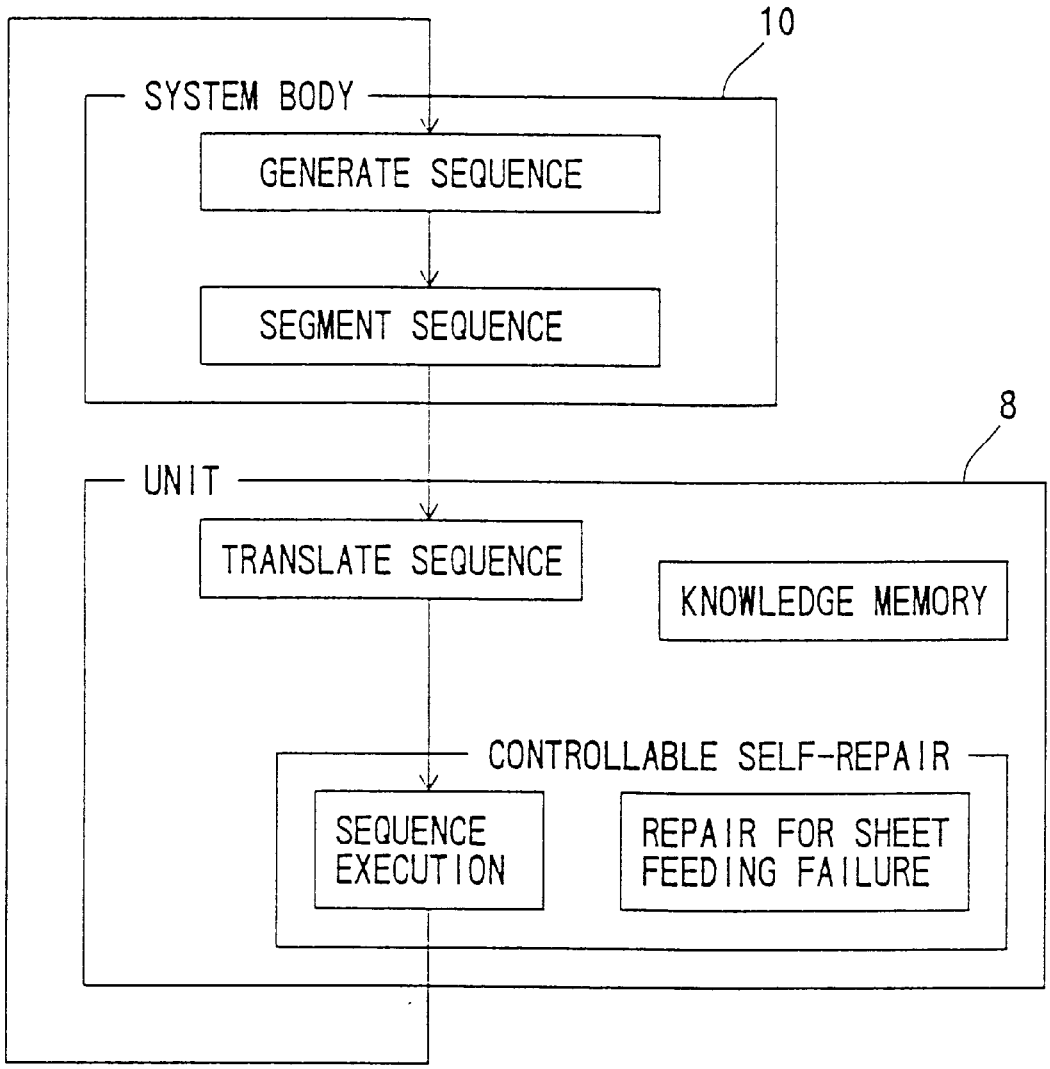
FIG. 2 is a block diagram for explaining the flow of the operation of the sheet transportation device.

FIG. 2 shows the flow of the operation of the sheet transportation device. The system body 10 constantly monitors the overall system. When there occurs a situation likely to cause a jam or to change the sheet transportation speed, the system body 10 generates a new control sequence for the overall system for functional maintenance of the system. The control sequence (for the overall system) generated by the system body 10 is segmented for each unit 8, and the resulting control sequence segments are applied to the respective units 8.

The respective units 8 each translate the control sequence segment applied thereto into a unit-executable quantitative sequence, and execute the quantitative sequence.

For example, it is assumed that a sheet transportation speed specified by the applied control sequence is 400 mm/s. When a sheet transportation speed sensed by the sensor is 380 mm/s, the sheet transportation speed is restored to the level (400 mm/s) specified in the control sequence by utilizing the controllable self-repairing technique.

When a sheet transportation failure such as plural-sheet feeding or no-sheet feeding occurs, the units 8 each autonomously perform a fault repairing operation, while executing the control sequence applied from the system body. The autonomous fault repairing operation is also based on the controllable self-repairing technique.

3. Precise Construction of System Body

Figure 3:
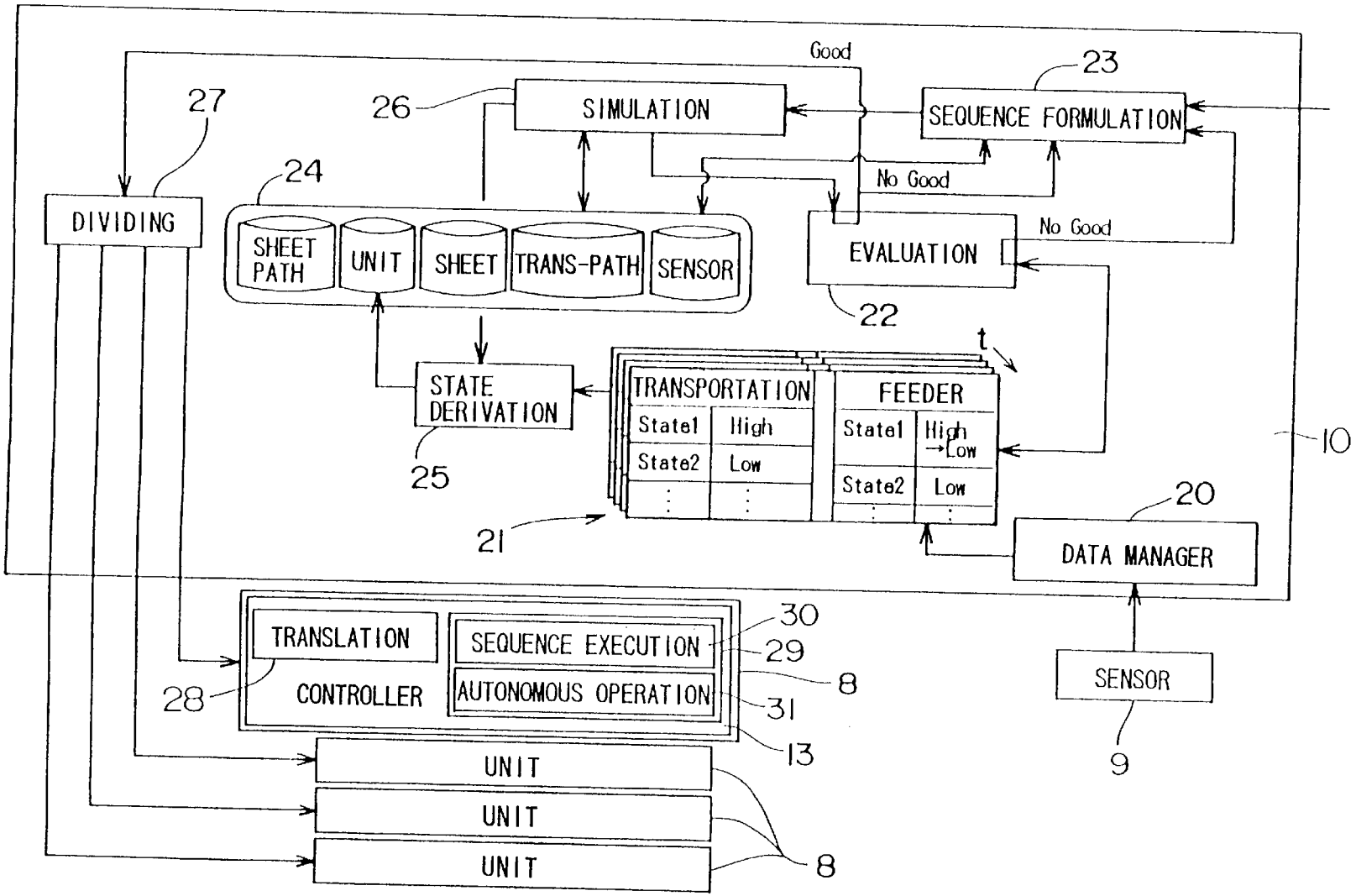
FIG. 3 is a functional block diagram for mainly explaining a system body of the sheet transportation device.

FIG. 3 is a functional block diagram of the entire device mainly illustrating the internal construction of the system body 10. The system body 10 has a control data management section 20. The control data management section 20 writes information concerning the respective units 8 into the data tables 21 in a predetermined updating cycle on the basis of signals from the sensors 9 provided in the units 8. Thus, the data tables 21 retain data indicative of the current states (latest states) of the respective units 8.

The system body 10 has the evaluation section 22. The evaluation section 22 performs diagnostics on the current states of the respective units 8 on the basis of the information on the units 8 written in the data tables 21. More specifically, the evaluation section 22 judges, for example, whether or not any of the units 8 is broken, whether or not the function of any of the units 8 is deteriorated, whether or not there is a possibility to cause a sheet jam, whether or not a sheet jam has occurred, and the like.

If the judgment results indicate that there is a possibility to cause a fault or that a fault has occurred (NO GOOD), the evaluation section 22 requests the sequence formulation section 23 to formulate a control sequence for repairing the fault. The control sequence formulated by the sequence formulation section 23 is subjected to simulation by the simulation section 26, and a simulation result is evaluated by the evaluation section 22. If the control sequence provides an evaluation result of "GOOD", the control sequence is segmented for each unit 8 by the dividing section 27, and the resulting control sequence segments are respectively applied to the units 8.

Briefly, the system body 10 constantly monitors the state of the overall sheet transportation system constituted by the plurality of units 8 and, if there occurs a situation likely to reduce the sheet feeding speed or to cause a sheet jam, an improved control sequence is newly generated for maintenance of the overall function of the system, and the improved control sequence is applied to the respective units 8.

In response to the request for the formulation of the control sequence from the evaluation section 22, the sequence formulation section 23 performs a control sequence formulation operation. At this time, the sequence formulation section 23 refers to the knowledge information written in a knowledge base 24 in the system body 10.

The knowledge base 24 retains virtual models required for fault repairing operations. More specifically, a sheet path model, a unit model, a sheet model, a transportation path model and a sensor model are written in the knowledge base 24. Among those, the sheet path model, the sheet model, the transportation path model and the sensor model are preliminarily defined.

The unit model is knowledge information corresponding to a difference between a state of a unit 8 expected by the system body 10 and an actual state of the unit 8 (e.g., deterioration of a component (e.g., transportation rollers) in the unit 8). The unit model is updated on the basis of data read out of the data table 21 by a state derivation section 25. In other words, the unit model is information indicative of a time-related change in the behavior of the unit 8.

More specifically, the state derivation section 25 receives information on an ideal behavior of a control sequence presently executed by the unit 8 from the simulation section 26. The state derivation section 25 determines a difference between the actual behavior information on the unit 8 written in the data table 21 and the ideal behavior information, and writes information indicative of the difference as a unit model into the knowledge base 24.

The sequence formulation section 23 formulates a control sequence by using the knowledge information including the unit model. Thus, the current state of the unit 8 can be taken into consideration for the formulation of the control sequence.

The control sequence formulated by the sequence formulation section 23 is a rough one which corresponds to a skeletal control sequence. Therefore, the control sequence is subjected to a transportation simulation to provide an ultimate control sequence.

In addition to the request from the evaluation section 22, the sequence formulation section 23 receives a request for the formulation of a control sequence from the outside when control specifications such as a transportation procedure are changed. In such a case, the sequence formulation section 23 formulates a control sequence in the same manner as described above.

The control sequence formulated by the sequence formulation section 23 is applied to the simulation section 26 as previously described.

The simulation section 26 simulates a sheet transportation operation in a virtual manner on the basis of the control sequence applied from the sequence formulation section. More specifically, the simulation section 26 specifies a transportation path and a sheet in a virtual manner on the basis of the sheet path model and the sheet model written in the knowledge base 24, and transports the virtual sheet along the virtual transportation path on the basis of the applied control sequence. At this time, the behavior of the virtual sheet is recognized by the simulation section 26. Further, the simulation section 26 obtains quantitative information such as a sheet transportation speed and the like at the unit 8, and reflects the quantitative information to the formulation of the control sequence. Thus, the formulation of the control sequence is completed.

The result of the sheet transportation simulation performed in the simulation section 26 is applied to the evaluation section 22. The evaluation section 22 determines on the basis of the simulation result applied from the simulation section 26 whether or not the control sequence formulated by the sequence formulation section 23 is valid.

If the evaluation result indicates that it is impossible to properly perform the sheet transporting operation on the basis of the formulated control sequence and to repair the fault (NO GOOD), the evaluation section 22 requests the sequence formulation section 23 again to formulate a control sequence. Conversely, if it is judged that the sheet transporting operation can properly be performed on the basis of the formulated control sequence for the fault repair (GOOD), the control sequence is applied to the dividing section 27.

The dividing section 27 segments the applied control sequence on a task basis, and the resulting control sequence segments are respectively applied to the corresponding units 8. More specifically, since the control sequence is a time-series program, it is predicted that plural units 8 are involved in the execution of the control sequence. Therefore, the control sequence segments are properly allocated to the units 8 responsible for the execution of the control sequence.

During the control sequence formulation process in the system body 10, the validity of the control sequence is evaluated by performing the simulation in the virtual sheet transportation system generated in the computer (system body 10), as described above. Therefore, fault prevention and fault repair can be achieved without interrupting the operations of the plurality of units 8 in the real sheet transportation system.

4. Knowledge Information to be Referred to by Units

As previously described, the control sequence generated by the system body 10 is segmented for each unit 8, and the resulting control sequence segments are applied to the respective units 8. The units 8 respectively translate the applied control sequence segments for execution of the control sequence.

The control sequence generated by the system body 10 takes into consideration the behavior of the sheet to give an instruction on a sheet state to be created by a unit, for example, an instruction of "transport the sheet at 400 mm/". To allow the respective units 8 to execute the control sequence concerning the behavior of the sheet, the control sequence should be translated into a unit control sequence (quantitative sequence) in consideration of the physical behavior of each unit 8. To transport the sheet at 400 mm/s, for example, it is necessary to derive operations to be performed by the unit 8, i.e., to specify the rotation speed of the motor, the nip pressure between the pair of transportation rollers and the operation state of the clutch required for maintaining the circumferential speed of the transportation rollers at 400 mm/s.

The units 8 each refer to the unit-specific knowledge information when translating the control sequence applied from the system body 10 into the unit executable sequence. As described above, the knowledge information is stored in the knowledge memory in each unit 8, but may be stored in the data table 21 in some cases.

An explanation will be given to the knowledge information to be referred to, taking the sheet supply unit 8 as an example.

The knowledge information for the sheet supply unit 8 includes a parameter model prepared by networking physical parameters in the sheet supply unit 8 on the basis of a cause and effect relation therebetween, and knowledge information on an actuator operation in the sheet supply unit 8 (e.g., a time required to attain a target control level of an actuator and a controllable range for the actuator operation).

4-1-1. Parameter Model

Figure 4A:
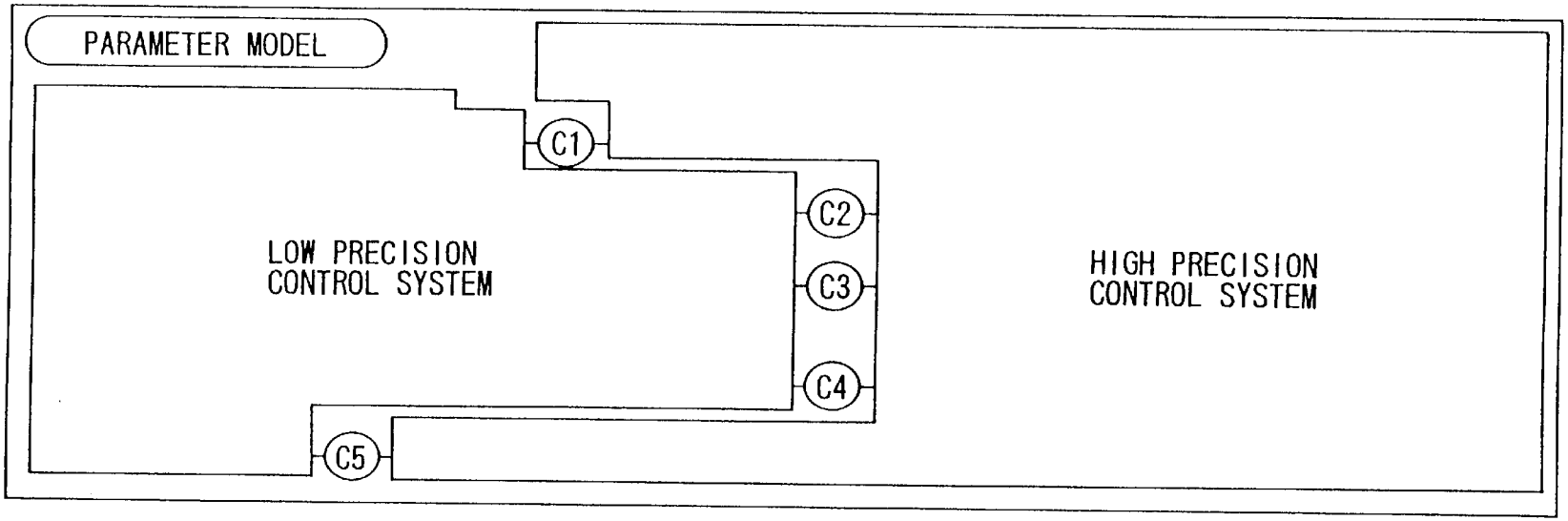
FIGS. 4A to 4C are diagrams illustrating a parameter model which is part of repair knowledge information retained in a sheet supply unit.
Figure 4B:
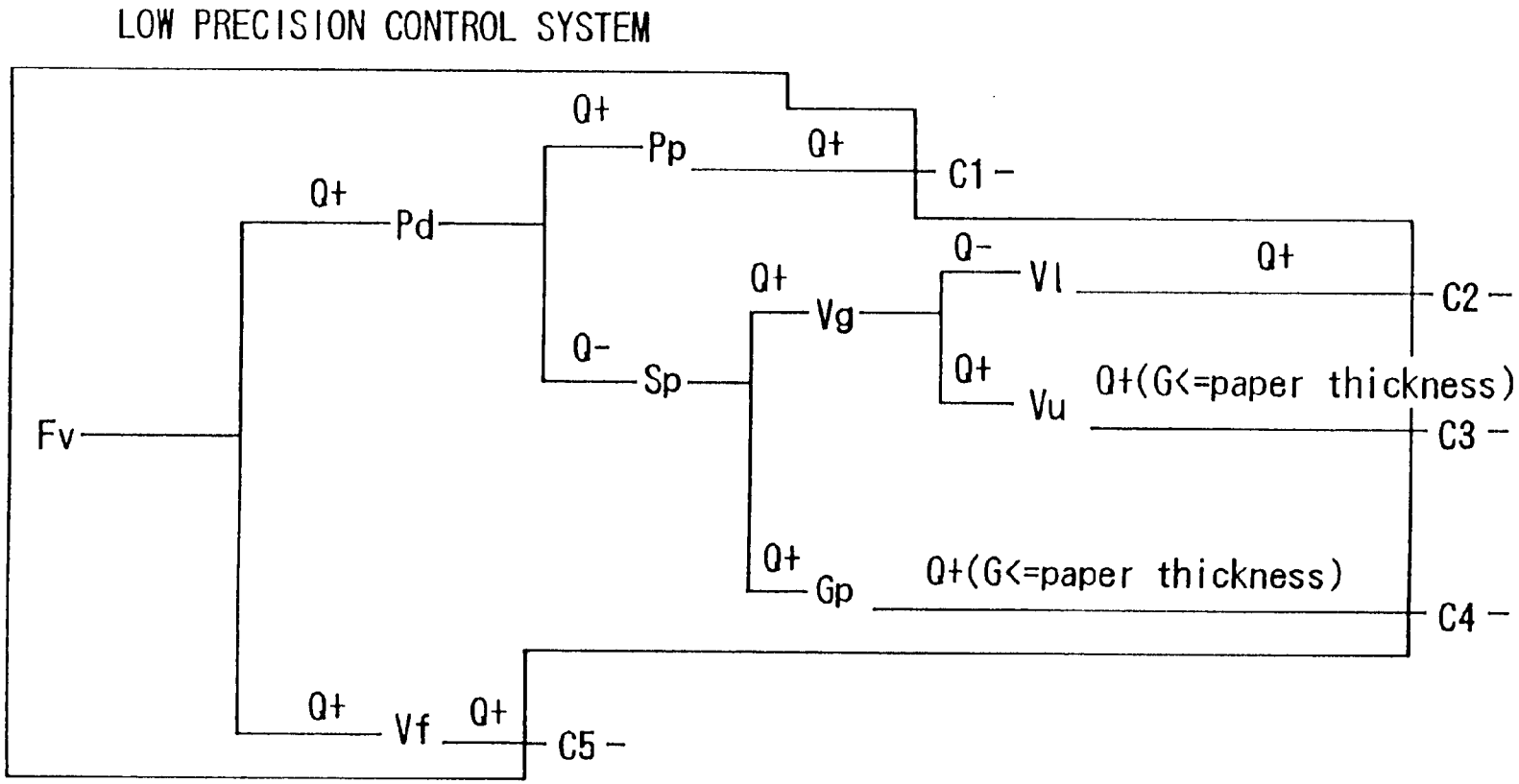
Figure 4C:
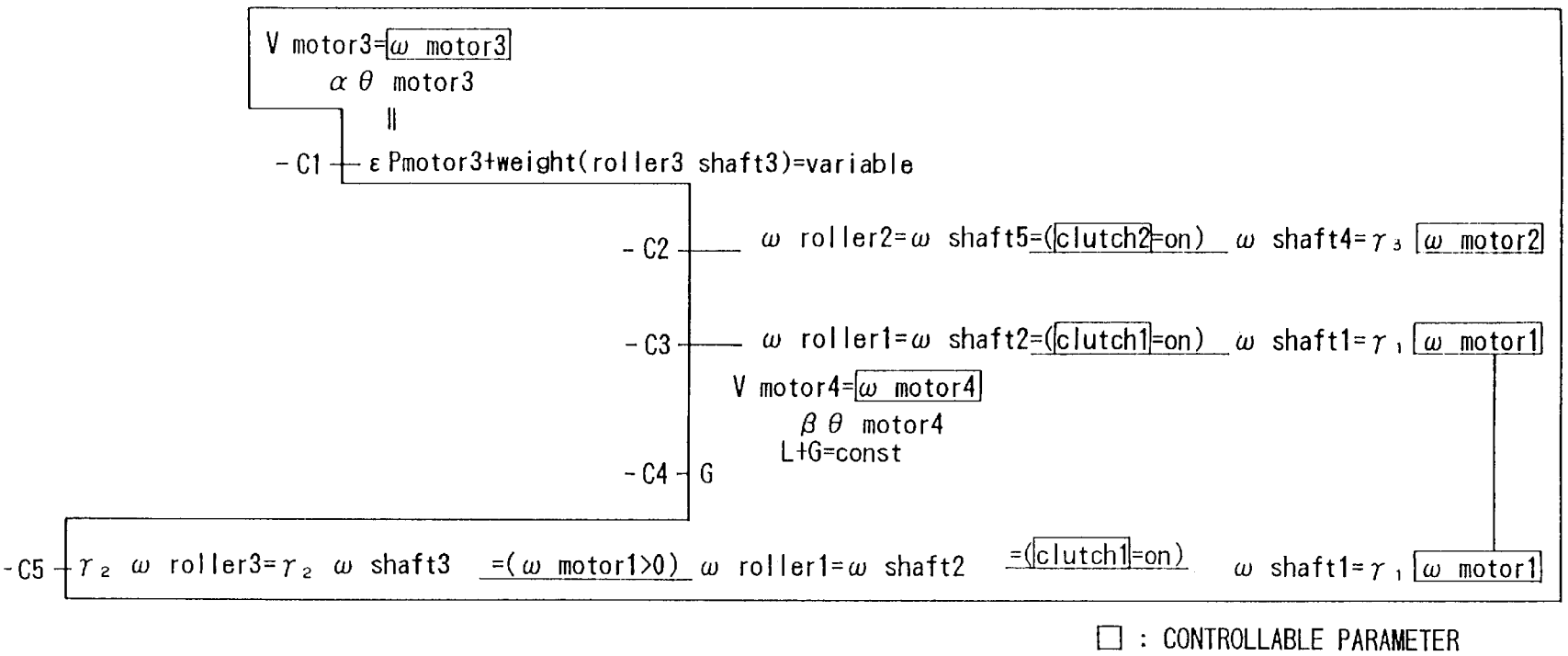

FIGS. 4A to 4C are diagrams illustrating a parameter model for the sheet supply unit 8. Here, FIG. 4A shows a layout of a low precision control system and a high precision control system, which are described later, in the parameter model, and FIGS. 4B and 4C show the low precision control system and the high precision control system in detail, respectively.

The parameter model for the sheet supply unit 8 includes quantitative information in addition to a conventional parameter model based on a qualitative cause and effect relation between the physical parameters (which is described in detail, for example, in Japanese Unexamined Patent Publication No. 4-130330 (1992) filed by the applicant of the present invention). Therefore, the parameter model shown in FIGS. 4 includes quantitatively controllable parameters and qualitatively controllable parameters.

The reference characters shown in FIGS. 4 respectively have the following meanings:

Fv: Transportation speed

Pd: Sheet transportation force

Vf: Sheet feeding speed

Pp: Sheet supply pressure

Sp: Sheet separating force

Vg: Speed difference between two rollers

Vl: Circumferential speed of lower roller

Vu: Circumferential speed of upper roller

G: Gap between two rollers $\gamma$: Gear ratio $\omega$: Angular velocity $\theta$: Angle $\epsilon$: Weight coefficient The parameters in the parameter model include directly manipulatable parameters and indirectly manipulatable parameters. The directly manipulatable parameters can directly be manipulated by controlling the actuator of the sheet supply unit 8. The indirectly manipulatable parameters can indirectly be manipulated by manipulating the directly manipulatable parameters. The indirectly manipulatable parameters are quantitatively or qualitatively correlated with the directly manipulatable parameters.

In the parameter model shown in FIGS. 4, a set (or group) of parameters quantitatively correlated with the directly manipulatable parameters can quantitatively be manipulated at a high precision. Therefore, the set of parameters is herein referred to as "high precision control system". A set of parameters qualitatively correlated with the parameters of the high precision control system can be manipulated only qualitatively, and is referred to as "low precision control system".

In FIGS. 4, "Q+" means a proportional qualitative relation, while "Q−" means an inversely proportional qualitative relation. The parameters enclosed in boxes are the directly manipulatable parameters.

4-1-2. Retrieval of Parameter to be Manipulated

Referring to FIGS. 4, a method of retrieving a parameter to be manipulated will be explained.

A parameter to be eventually manipulated for operation by using the parameter model of the sheet supply unit 8 is the transportation speed Fv which is located at the highest position of the parameter model.

A method for increasing the level of the parameter Fv will herein be considered. As can be seen from FIGS. 4, the Fv level can be increased by increasing the level of the parameter Pd or Vf which has a proportional qualitative relation with the parameter Fv. Then, a method for increasing the Pd level will be considered. The Pd level can be increased by increasing the level of the parameter Pp having a proportional qualitative relation with the parameter Pd or by decreasing the level of the parameter Sp having an inversely proportional qualitative relation with the parameter Pd. Then, a method for increasing the Pp level will be considered. The Pp level can be increased by increasing the level of a parameter Pmotor3 having a proportional qualitative relation with the parameter Pp. In consideration of a quantitative relation with the parameter Pmotor3, a parameter ωmotor3 is eventually manipulated in such a direction that the Pmotor3 level is increased.

Where other parameters are to be manipulated, a parameter to be manipulated and a method for manipulating the parameter in the parameter model are determined in substantially the same manner as described above. Two or more parameters may be manipulated at a time.

When the control sequence generated in the system body is translated into a unit-executable control sequence, a parameter or an actuator to be manipulated can be determined with reference to the parameter model.

If a conditional expression shown in the parameter model of FIGS. 4 is not satisfied, two adjacent portions linked by the conditional expression have no cause-effect relation. For example, if a conditional expression (clutch2=on) is not satisfied in the high precision system, a portion on the left side thereof is separated from a portion on the right side thereof. This means that the configuration of the parameter model of the sheet supply unit 8 varies depending on the conditions of the unit.

4-1-3. Qualitative Spaces and Landmarks

Figure 5B:
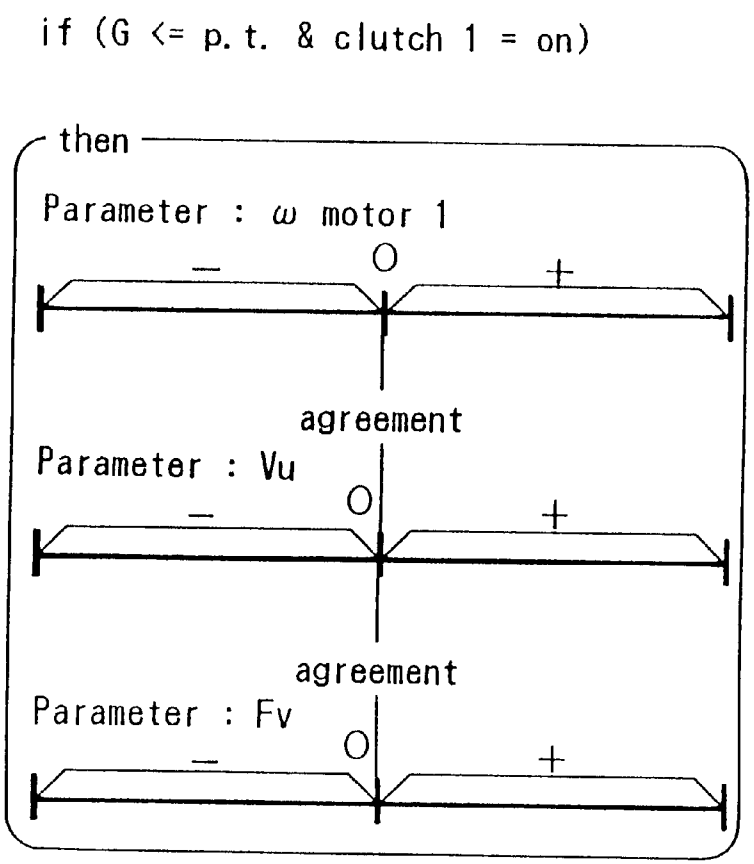
FIGS. 5A and 5B are diagrams illustrating exemplary qualitative spaces for parameters and landmarks of the parameters which are part of knowledge information for the parameter model.
Figure 5A:
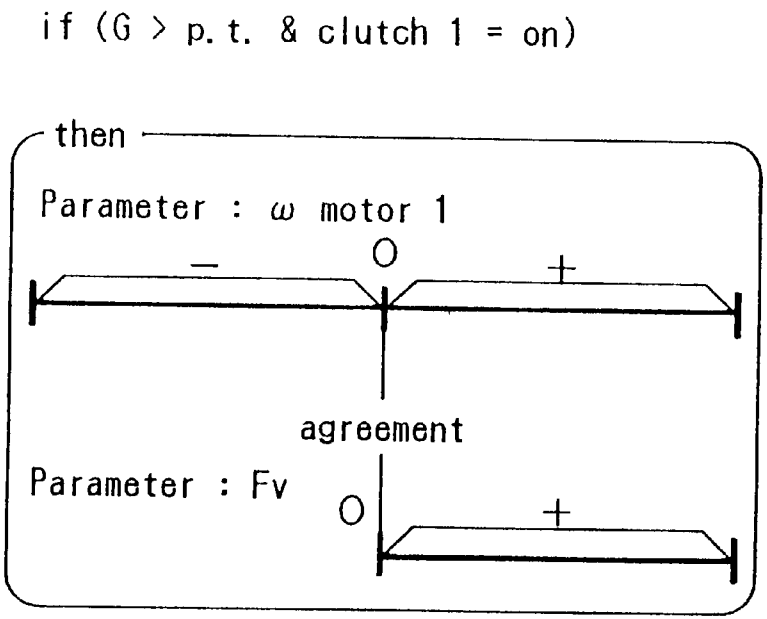

The parameters shown in the parameter model of FIGS. 4 have qualitative spaces as shown in FIGS. 5A and 5B.

For example, the qualitative space of FIG. 5A indicates that, if the value of the parameter ωmotor1 is smaller than zero, the motor rotates in a negative direction and, if the value is greater than zero, the motor rotates in a positive direction. This also indicates that the parameter value is changed from the negative side to the positive side through zero.

Further, the qualitative space indicates that, if the value of the parameter Fv is greater than zero or positive, a sheet is transported at a certain speed.

The qualitative space has landmarks at which the states of the parameters are completely changed. The landmarks of the parameters are not necessarily present independently, but are aligned with each other under certain conditions of the model configuration as shown in FIGS. 5A and 5B. In the qualitative space of FIG. 5A, the landmarks of the parameters are aligned with each other if a conditional expression (G>p.t. & clutch1=on) is satisfied.

In the qualitative space of FIG. 5B, the landmarks of the parameters are aligned with each other if a conditional expression (G≦p.t. & clutch1=on) is satisfied.

Knowledge information on the qualitative spaces and the landmarks is also stored in the knowledge memory as additional knowledge information for the aforesaid parameter model, and utilized for the translation of the control sequence and for the execution of the control sequence.

By monitoring the conditions for the alignment of the landmarks in the qualitative spaces, the creation of an unlikely unit state can be prevented.

4-2. Actuator Operation Knowledge Information

Knowledge information on the actuator operation is also stored in the knowledge memory of each unit 8.

An explanation will next be given to the knowledge information on the actuator operation retained by the sheet supply unit 8. The knowledge information includes a time required for the operation of an actuator, the controllable range of the actuator, the state of a sheet and the state of the actuator.

4-2-1. Time Required for Actuator Operation

To operate an actuator at a target control level, the time required for the actuator operation should be taken into consideration, which depends on the performance of the actuator (hardware component).

FIG. 6 is an exemplary list of times required for the actuator operation.

Referring to FIG. 6, "Parameter" represents parameters of each actuator in the sheet supply unit 8, and corresponds to the directly manipulatable parameters in the parameter model. "Operation" represents directions in which each actuator is to be operated, and is represented on a qualitative basis (up, down) or on a binary basis (on, off). "Time" represents times required for the actuator to attain a target control level. When the ωmotor1 level is to be increased by operating the actuator 10 times, for example, (20+3×10) ms (milli-second) is required.

When the control sequence applied from the system body is translated into a quantitative sequence for each unit, the physical construction and ability of the unit can be taken into consideration with the knowledge information concerning the time required for the actuator operation.

4-2-2. Controllable Range of Actuator

Each actuator is operated within its controllable range. FIG. 7 is an example of knowledge information on controllable ranges for the actuator operation.

Referring to FIG. 7, the definitions of "Parameter" and "Operation" are the same as those in FIG. 6. Where the actuator is a motor, for example, "Controllable range from a zero control level" means a controllable range between zero and the highest or lowest controllable level of the rotation speed of the motor. The parameter ωmotor1 can be controlled at 127 levels in an up operation direction and in a down operation direction.

4-2-3. Relationship between Sheet State and Actuator State

The relationship between the sequence applied from the system body 10 and the behavior of a unit 8 is stored as knowledge information for each unit. An example thereof is shown in FIG. 8.

Referring to FIG. 8, "Paper State" represents the state of a sheet. "FREE" indicates a state where no force is applied to the sheet. "F-DRIVE" indicates a state where the sheet is transported forward. "FIX" indicates a state where the sheet is caught by rollers and the like. "B-DRIVE" indicates a state where the sheet is transported backward. "Parameter State" represents the states of the respective parameters. As previously described, "Pd" is the sheet transportation force, and "Vf" is the sheet feeding speed.

5. Repairing Operations

Repairing operations to be performed in each unit 8 include a repairing operation in which the unit 8 executes a control sequence modified by the system body 10 for maintenance of the overall system function as described above, and a repairing operation which is autonomously performed by the unit 8 independently of the system body 10. These repairing operations are based on the controllable self-repairing technique.

5-1. Controllable self-Repairing Technique

The controllable self-repairing technique, in general, realizes the self-repair by controlling an actuator without reconstruction or reconfiguration of an objective machine. The self-repair is achieved by controlling the level of a parameter related to a function damaged by a fault. More specifically, a parameter to be manipulated is retrieved from the aforesaid parameter model, and an actuator required for changing the level of the parameter is selected.

In the controllable self-repairing technique, the aforesaid knowledge information stored in the knowledge memory is referred to. More specifically, the knowledge information to be referred to includes the parameter model shown in FIGS. 4, qualitative spaces for the respective parameters and the landmark alignment conditions shown in FIGS. 5A and 5B, the actuator operation times shown in FIG. 6, the controllable ranges for the actuator operation shown in FIG. 7 and the relationship between the sheet state and the actuator state shown in FIG. 8.

5-2. Algorithm for Controllable Self-Repairing Operation

Figure 9:
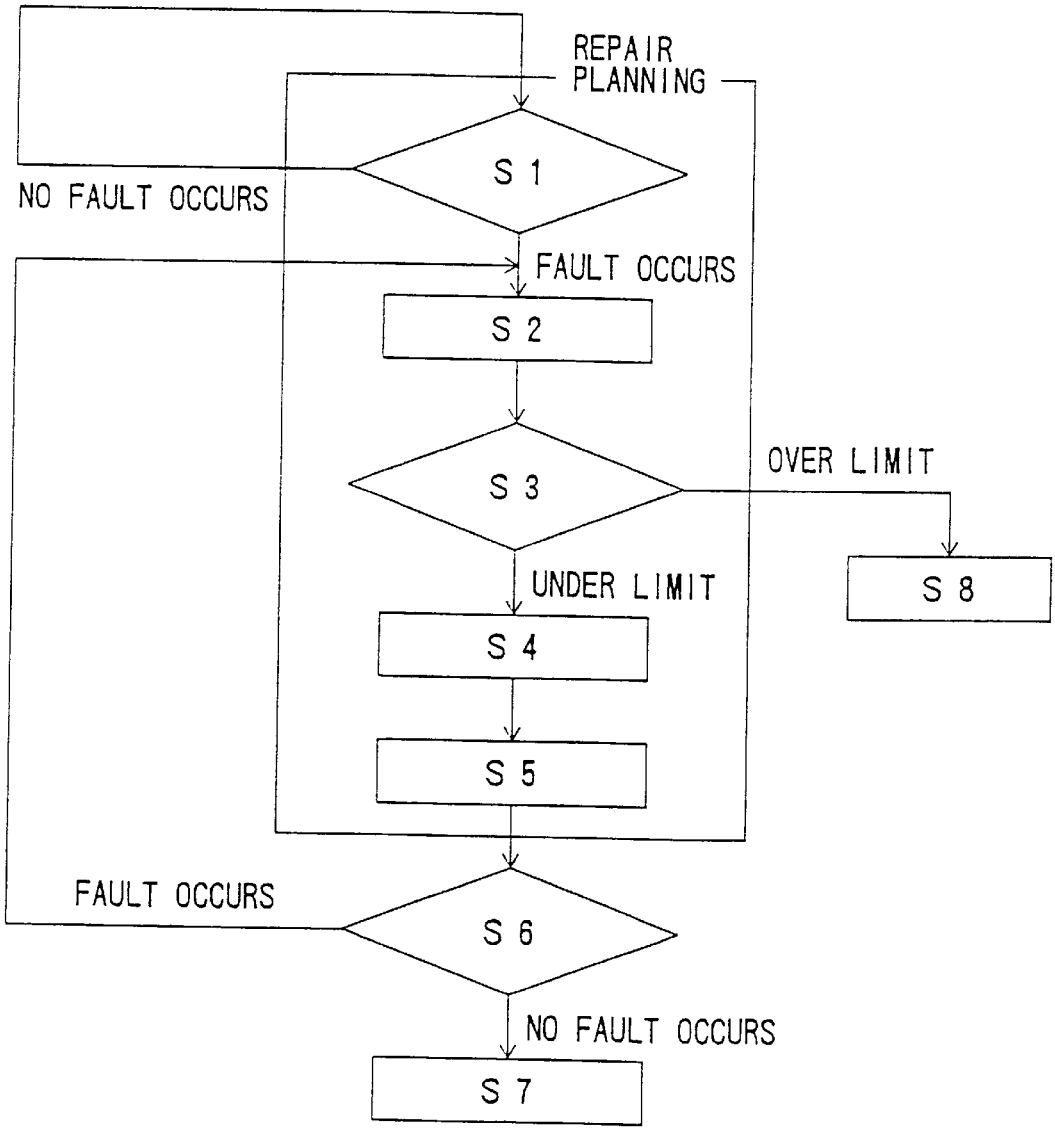
FIG. 9 is a flow chart illustrating an exemplary algorithm for a controllable self-repairing technique.

FIG. 9 is a flow chart illustrating an exemplary algorithm for the controllable self-repairing operation.

Referring to FIG. 9, an explanation will be given to operations to be performed at respective stages of the repair algorithm.

Step S1: Fault Judgment

The output levels of sensors for fault detection are monitored, and the occurrence of a faulty state is judged on the basis of the sensor output levels. The fault judgment is constantly performed during the sheet feeding operation.

More specifically, if a sheet transportation speed obtained as a result of the execution of the control sequence in the unit does not reach a sheet transportation speed defined by the control sequence, for example, it is judged that a fault occurs.

Further, if the orientation of a sheet being transported is biased with respect to a sheet orientation preliminarily defined by the knowledge information, it is judged that a fault (biased sheet transportation) occurs.

Step S2: Fault Diagnosis

Possible causes of the fault are inferred from the faulty state and the parameter model.

Step S3: Actuator Limit Check

With reference to the actuator controllable ranges (see FIG. 7) in the knowledge memory, operation margins of the respective actuators are checked, and an actuator having little operation margin is excluded from actuators to be operated for the repairing operation.

Step S4: Repair Planning

Parameters to be manipulated for the repairing operation are retrieved from the parameter model on the basis of the faulty state and the possible causes of the fault. If a plurality of parameters are to be manipulated, the priorities of the parameters or a parameter manipulation order are determined. Upon the determination of the parameters to be manipulated, a repairing operation sequence is determined. At this time, the knowledge information on the operation of the actuators corresponding to the parameters to be manipulated is referred to.

Step S5: Repair Implementation

The repairing operation is performed on the basis of the sequence determined in the repair planning step.

The process sequence from Step S1 to Step S5 is performed in the repair planning section. Next, an operation after the repairing operation will be explained.

Step S6: Fault Judgment

It is judged whether or not the sensor output levels are each restored to a normal range as a result of the operation performed in the process sequence from Step S1 to Step S5. If the sensor output levels are not restored, the process returns to Step S2 for fault diagnosis.

Step S7: Successful Fault Repair

If the result of the fault judgment in Step S6 is normal, the fault repair is successful. The sheet feeding operation is continued in this state.

Step S8: Fault Repair Failed

If it is impossible to operate the actuators for the repairing operation in Step S3 when the fault occurs, the fault repair is failed.

5-3. Repairing Operation in Sheet Supply Unit

FIGS. 10A to 10D are diagrams illustrating the construction and operation of the sheet supply unit for the self-repairing operation.

The sheet supply unit includes a translation section for translating a sequence generated in the system body into a unit-executable sequence, a sequence execution section for executing the translated sequence, an autonomous operation section for allowing the unit to autonomously perform a fault repairing operation independently of the sequence execution section on the basis of the controllable self-repairing technique, and an actuator operation section.

Figure 10A:
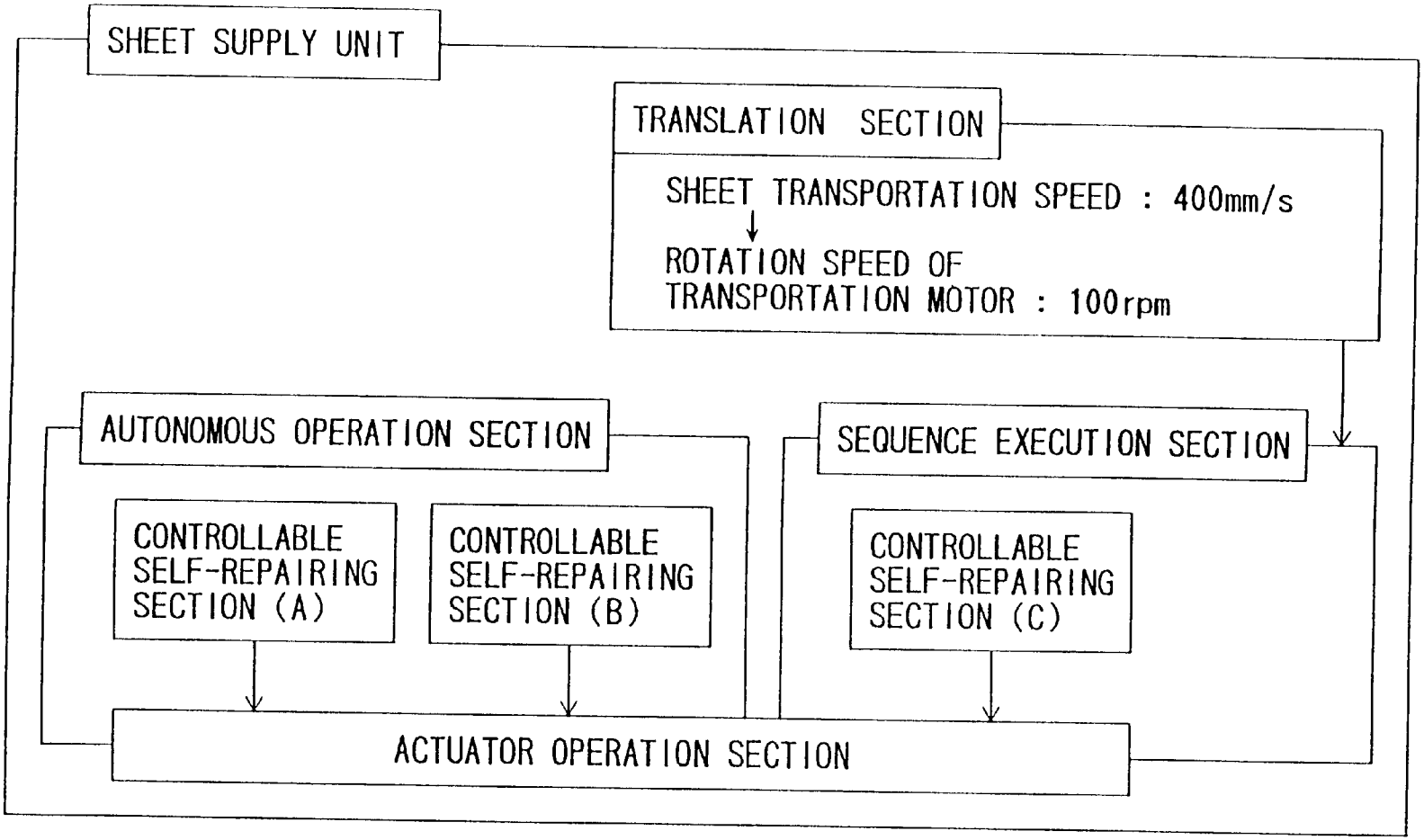
FIGS. 10A to 10D are diagrams illustrating the construction and operation of the sheet supply unit for the self-repairing operation.
Figure 10B:
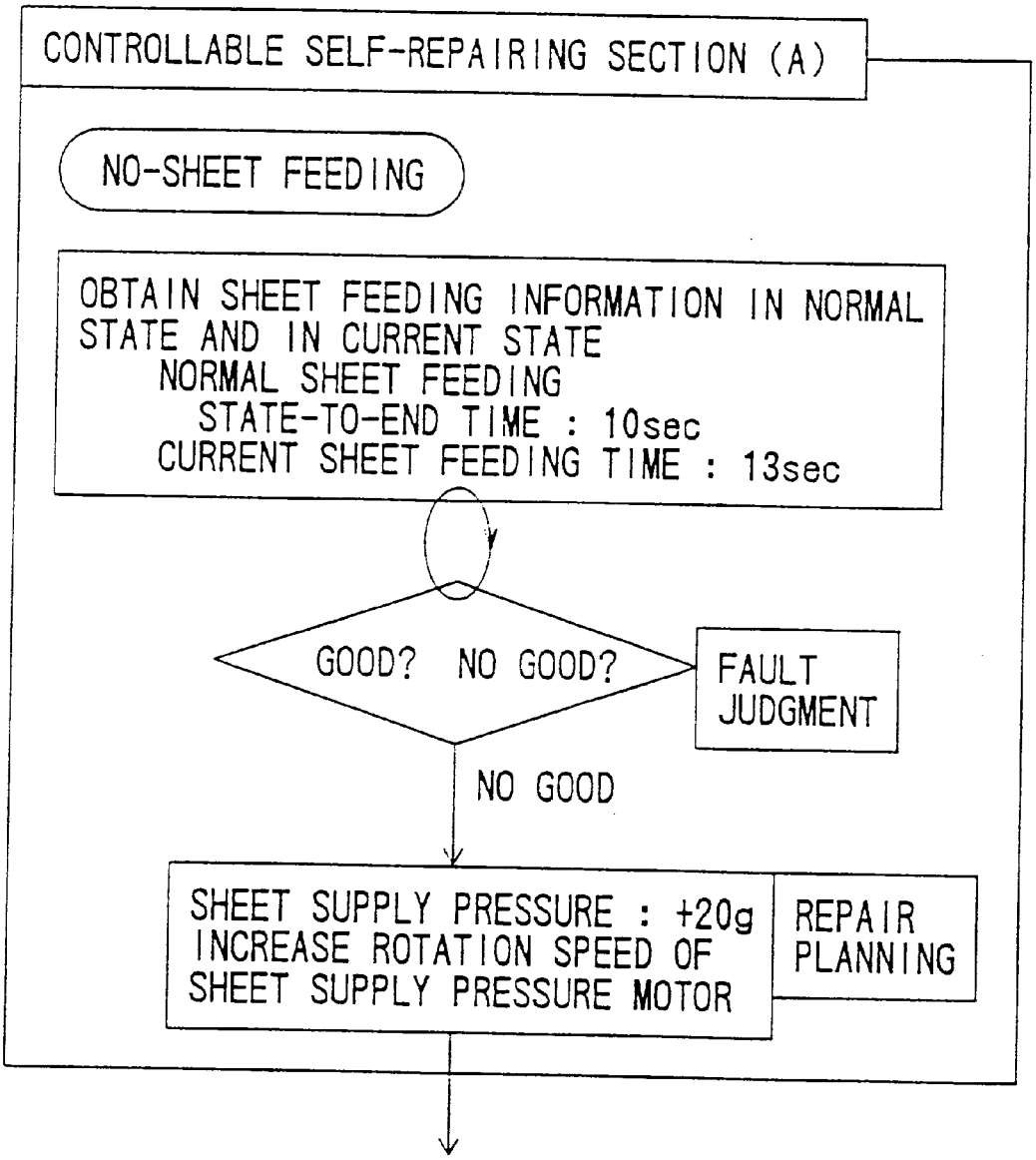
Figure 10C:
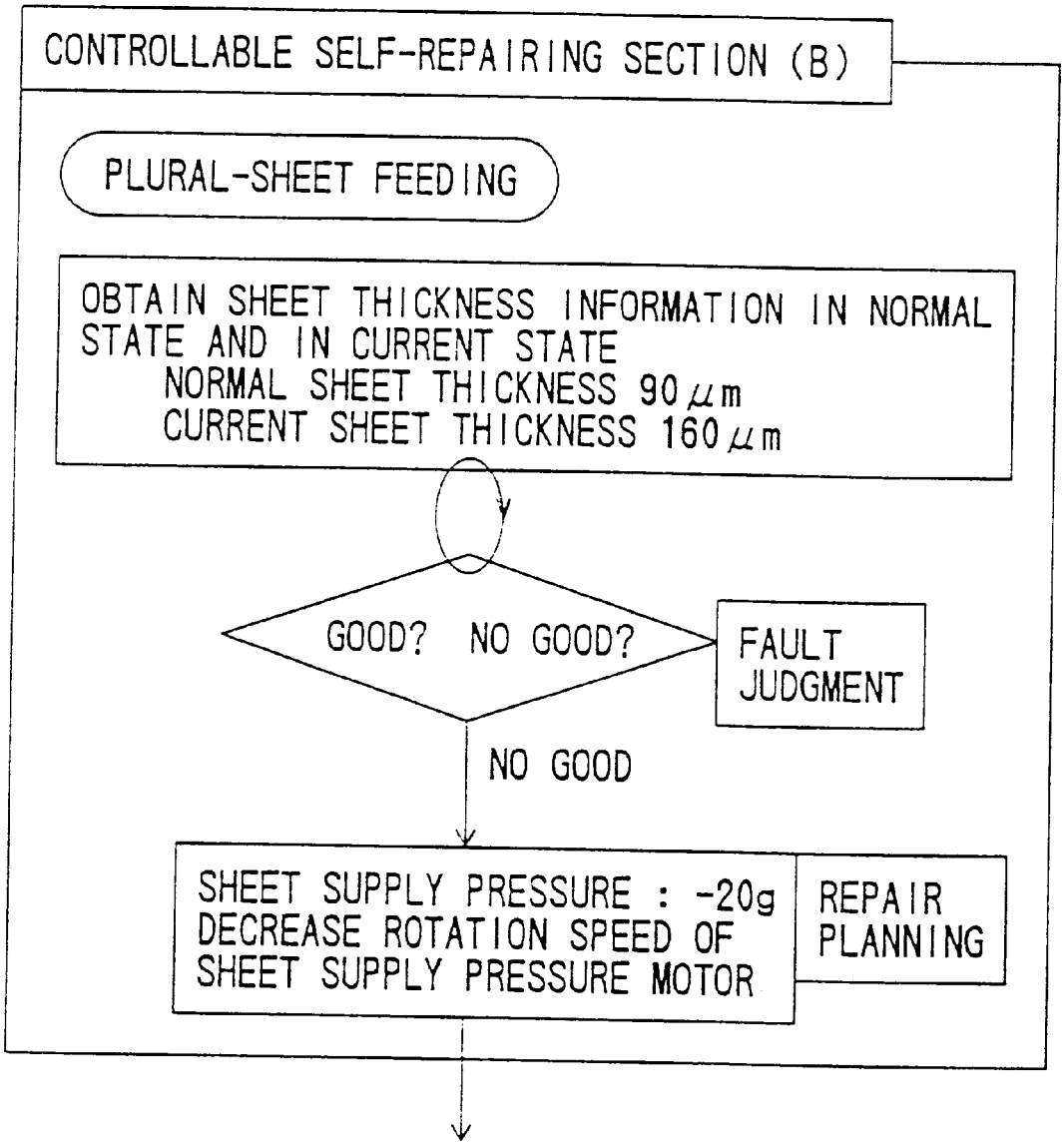
Figure 10D:
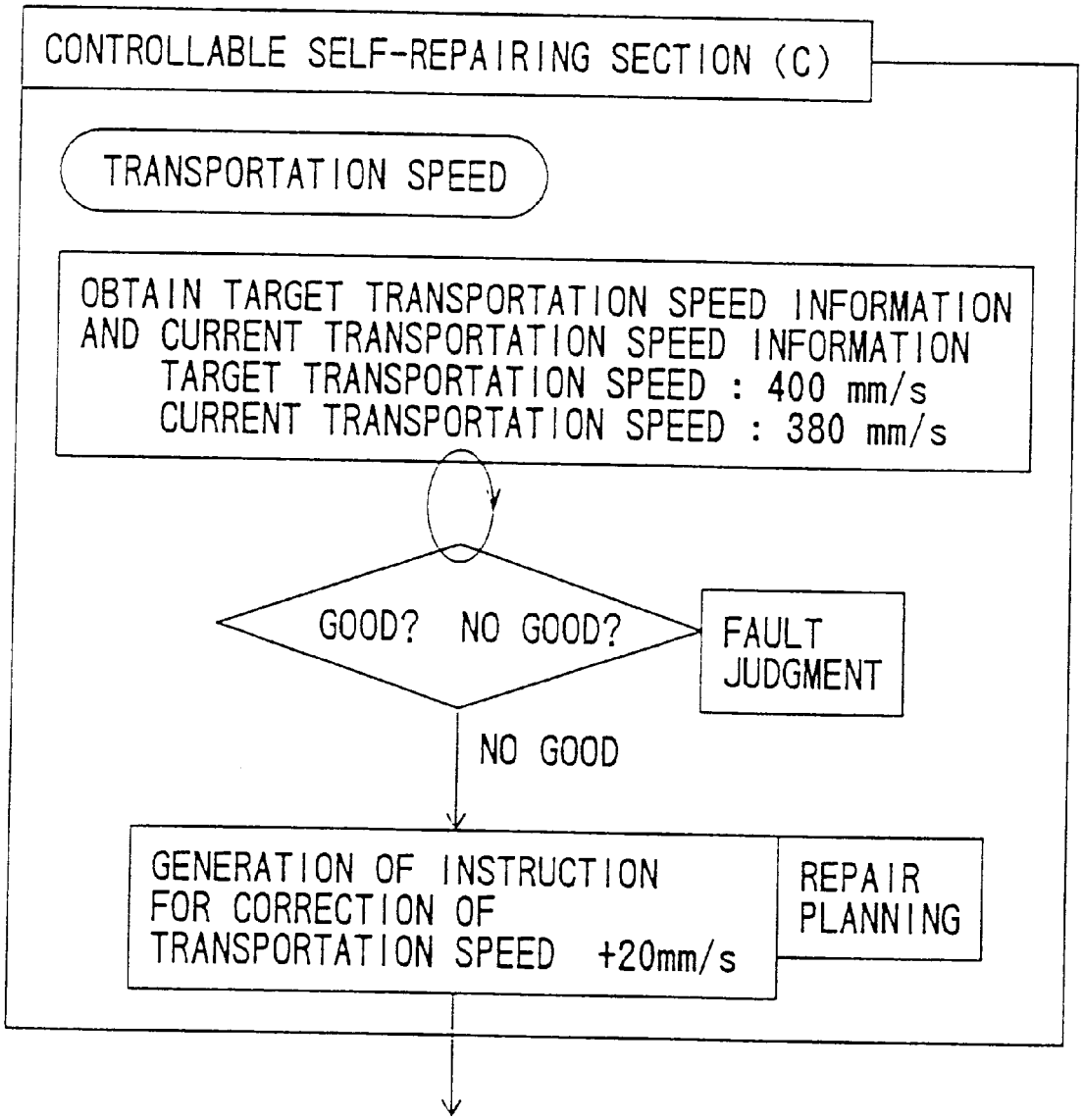

In FIGS. 10, FIG. 10A is for showing a layout of the translation section, the autonomous operation section, the sequence execution section and the actuator operation section, and FIGS. 10B, 10C and 10D are each for illustrating controllable self-repairing sections (A), (B) and (C) shown in FIG. 10A.

The sequence execution section further includes a controllable self-repairing section for constantly monitoring the result of the sequence execution and, if the result is different from an expectative state specified by the control sequence generated by the system body, correcting the difference between the result and the expectative state on the basis of the controllable self-repairing technique.

The autonomous operation section has controllable self-repairing sections respectively adapted to correct plural-sheet feeding and no-sheet feeding.

A control sequence generated in the system body, for example, specifying a sheet transportation speed of 400 mm/s is converted into a unit-executable sequence, for example, specifying a transportation motor speed of 100 rpm in the translation section. The unit-executable sequence is applied to the actuator operation section via the sequence execution section, and executed therein.

The result of the sequence execution by the actuator operation section is constantly monitored by the controllable self-repairing section in the sequence execution section. If the result is different from an expectative state specified by the control sequence generated by the system body (e.g., the result is a sheet transportation speed of 380 mm/s), the controllable self-repairing section makes a repair plan to correct the difference (i.e., 400−380=20 mm/s), for example, by increasing the rotation speed of the transportation motor (or the circumferential speed of the rollers). The repair plan is applied to the actuator operation section, which performs a repairing operation in accordance with the repair plan.

The autonomous operation section constantly monitors the state of the sheet supply unit, and performs a controllable self-repairing operation to prevent sheet transportation failures such as plural-sheet feeding and no-sheet feeding independently of the sequence execution section.

More specifically, the repairing operation for the correction of the no-sheet feeding is performed in the following manner.

A time actually required for the sheet feeding is first measured, and compared with a normal sheet feeding start-to-end time. If the actual sheet feeding time is 13 seconds and the normal sheet feeding start-to-end time is 10 second, for example, the difference therebetween is 3 seconds. In such a case, it is judged that the no-sheet feeding has occurred.

Subsequently, the fault diagnosis is performed. With reference to the faulty state, the data table and the parameter model, it is judged, for example, that the fault has occurred due to reduction in the sheet supply pressure. The sheet supply pressure herein means a force required for the sheet supply unit to force a sheet to travel forward in a sheet feeding direction.

Then, the actuator limit check is conducted to check the operation margin of an actuator. If the actuator has little operation margin, the repair attempt is failed.

If the actuator has a sufficient operation margin, a repair plan for the correction of the no-sheet feeding is made on the basis of the parameter model. In the aforesaid case, for example, a repair plan is made to increase the sheet supply pressure.

The repair plan is applied to the actuator operation section, which operates the actuator to increase the sheet supply pressure, more specifically, to increase the rotation speed of a sheet supply pressure motor.

The controllable self-repairing section for the correction of the no-sheet feeding performs the fault judgment again and, if the judgment result indicates that the operation state is normal, the sheet feeding operation is continued in this state. If the result indicates that the operation state is still abnormal (the no-sheet feeding state is still observed), the process sequence from the actuator limit check is performed again.

The controllable self-repairing section for the correction of the plural-sheet feeding performs a repairing operation in substantially the same manner as described above on the basis of the controllable self-repairing technique to correct the plural-sheet feeding.

5-4. Repairing Operation in Transportation Unit

Figure 11A:
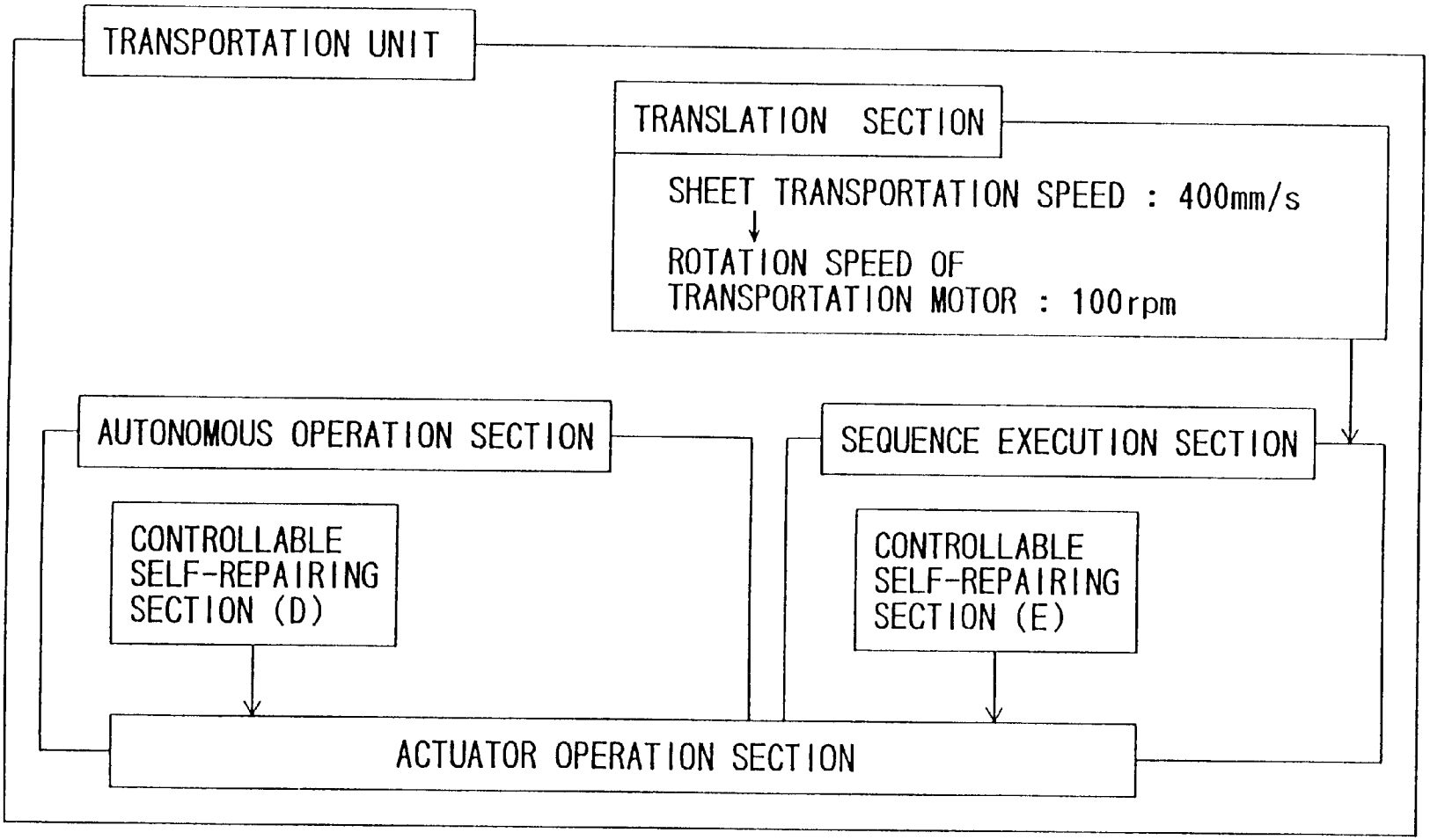
FIGS. 11A to 11C are diagrams illustrating the construction and operation of the transportation unit for the self-repairing operation.
Figure 11B:
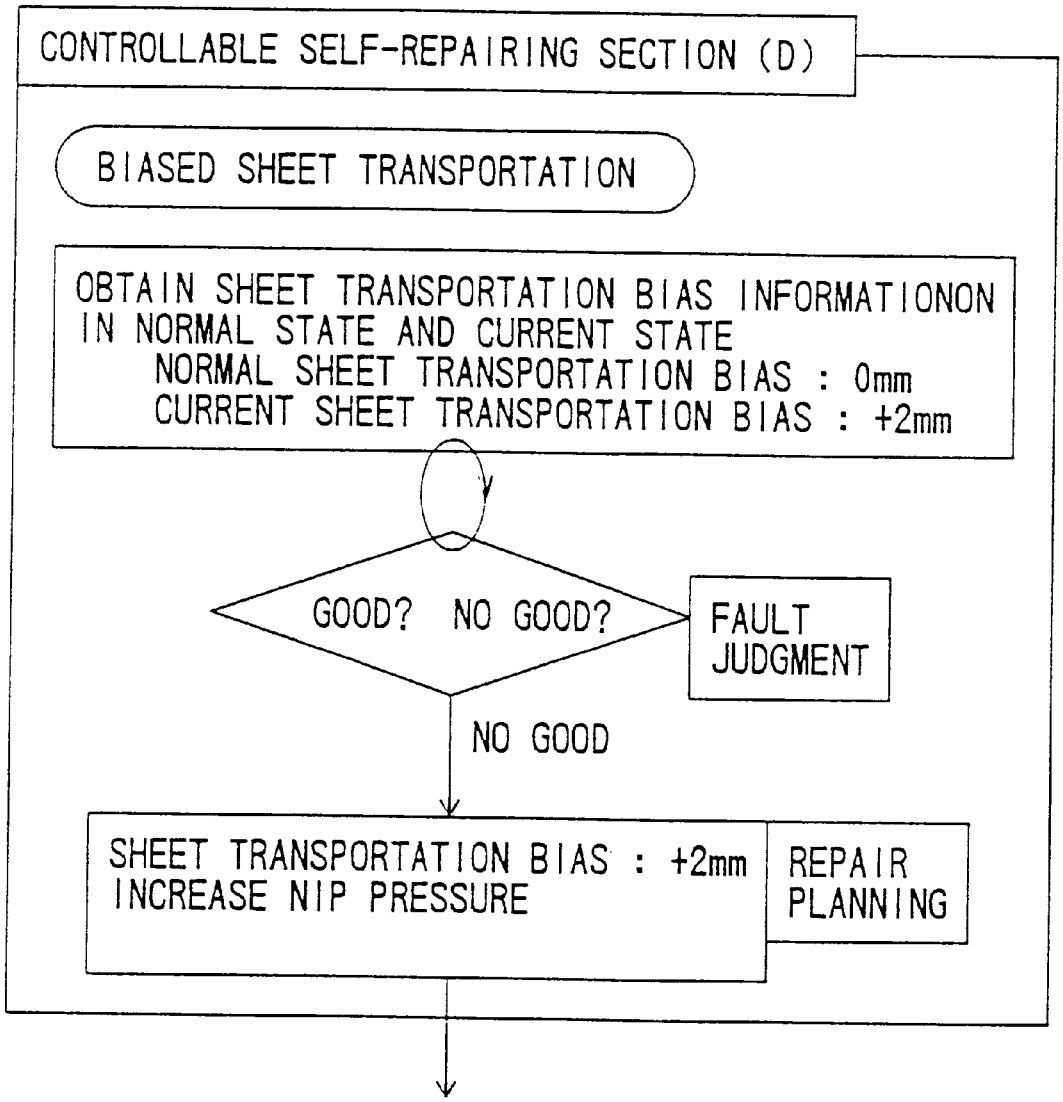
Figure 11C:
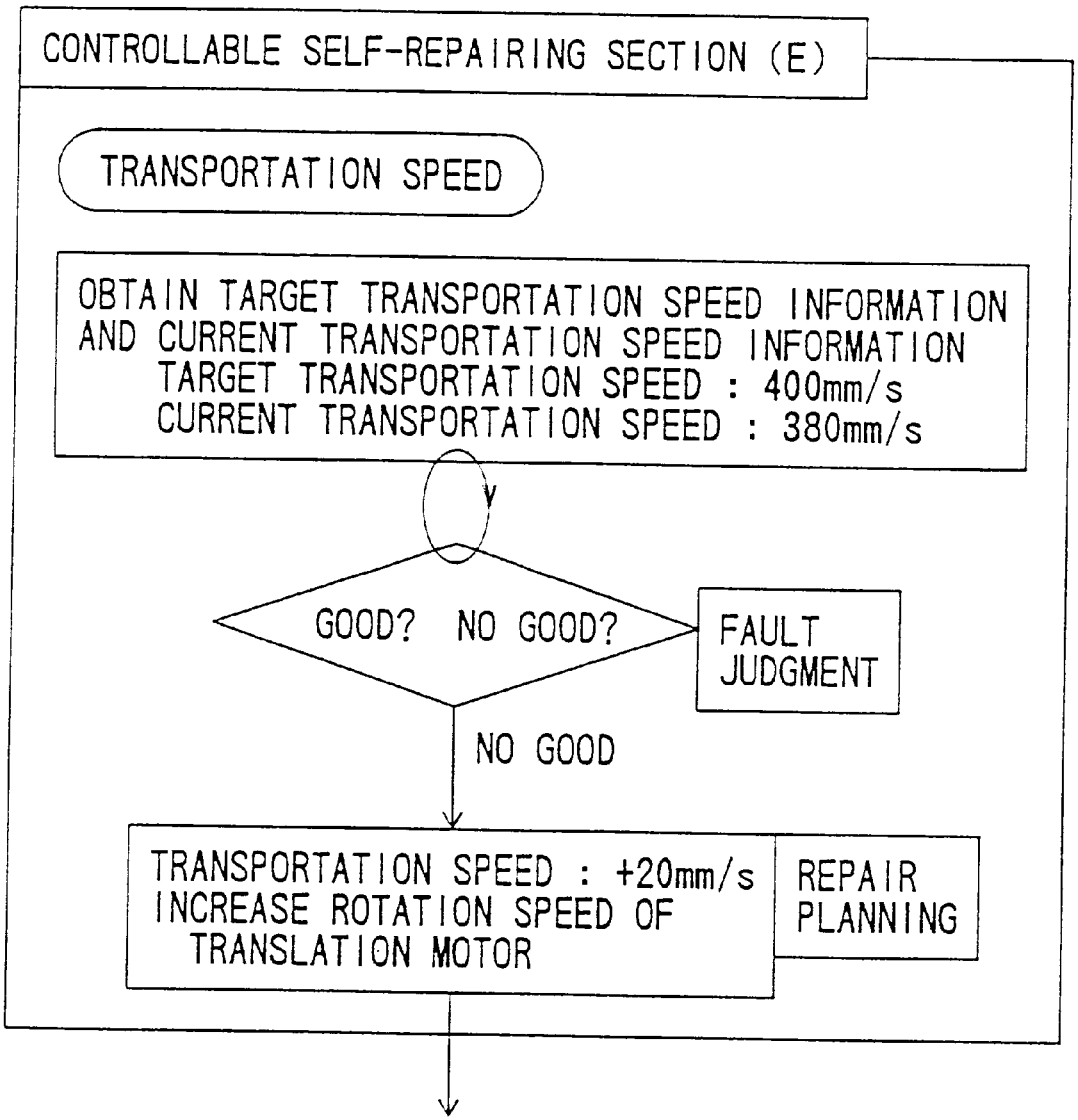

FIGS. 11A to 11C are diagrams illustrating the construction and operation of the transportation unit for the self-repairing operation.

The transportation unit includes a translation section for translating a sequence generated in the system body into a unit-executable sequence, a sequence execution section for executing the translated sequence, an autonomous operation section for allowing the unit to autonomously perform a fault repairing operation independently of the sequence execution section on the basis of the controllable self-repairing technique, and an actuator operation section.

In FIGS. 11, FIG. 11A is for showing a layout of the translation section, the autonomous operation section, the sequence execution section and the actuator operation section, and FIGS. 11B and 11D are each for illustrating controllable self-repairing sections (E) and (D) shown in FIG. 11A.

The sequence execution section further includes a controllable self-repairing section for constantly monitoring the result of the sequence execution and, if the result is different from an expectative state specified by the control sequence generated by the system body, correcting the difference between the result and the expectative state on the basis of the controllable self-repairing technique.

The autonomous operation section has a controllable self-repairing section for correcting biased sheet transportation.

A control sequence generated in the system body, for example, specifying a sheet transportation speed of 400 mm/s is converted into a unit-executable sequence, for example, specifying a transportation motor speed of 100 rpm in the translation section.

The unit-executable sequence is applied to the actuator operation section via the sequence execution section and executed therein. The result of the sequence execution by the actuator operation section is constantly monitored by the controllable self-repairing section in the sequence execution section. If it is determined that the result is different from an expectative state specified by the control sequence generated in the system body (e.g., the result is a sheet transportation speed of 380 mm/s), the controllable self-repairing section makes a repair plan to correct the difference (i.e., 400−380= 20 mm/s), for example, by increasing the rotation speed of the transportation motor. The repair plan is applied to the actuator operation section, which performs a repairing operation in accordance with the repair plan.

Besides the aforesaid control sequence execution, the controllable self-repairing section in the autonomous operation section constantly monitors the sheet transportation to check if the biased sheet transportation occurs. If the result of the monitoring by the controllable self-repairing section indicates that the biased sheet transportation occurs (e.g., with a sheet transportation bias of +2 mm), the controllable self-repairing section makes a repair plan to correct the biased sheet transportation (e.g., by increasing the nip pressure). The repair plan is applied to the actuator operation section, which performs a repairing operation in accordance with the repair plan.

5-4. Check of Interaction between Repairing Operations

When the self-repairing operations for the correction of the sheet transportation speed and for the correction of the biased sheet transportation are performed in parallel, the parameter manipulation for one repairing operation may influence the other repairing operation. However, the interaction between these repairing operations can be predicted on the basis of the parameter model and it is therefore possible to take into consideration the interaction to perform the self-repairing operations.

6. Miscellaneous

The construction of the sheet transportation unit and the control system according to the present invention can widely be applied to sheet transportation systems for use in image forming apparatuses such as copying machines, printers and facsimile machines.

In such a case, the control device for the sheet transportation system may be incorporated in a control device provided in a main body of an image forming apparatus.

In accordance with the present invention, the sheet transportation device for the image forming apparatus can flexibly adapt itself to external interferences such as changes in the sheet material and the use environment to ensure proper sheet transportation. Further, the sheet transportation device can perform diagnostics on a sheet transportation failure and malfunction, which may occur due to a time-related change of the hardware components of the sheet transportation system, for fault preventive maintenance. Further, if a fault occurs, the sheet transportation device can self-repair the fault.

Therefore, the sheet transportation device for use in an image forming apparatus ensures a highly reliable operation and yet requires less labor for the maintenance and inspection.

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

What is claimed is:

1. A sheet transportation device having a sheet transportation system constituted by a plurality of units, the plurality of units each comprising:

a plurality of components including an actuator and an action device to be actuated or brought in a varied state by the actuator;

a sensor for sensing a state of a predetermined component;

knowledge storage means storing therein knowledge information on a parameter model in which the components are represented on the basis of cause-effect relations between physical parameters thereof and knowledge information on operation of a predetermined actuator;

sequence execution means for executing a control sequence to perform a sheet transportation operation in association with the other units of the sheet transportation system;

means for monitoring an output of the sensor and judging a fault on the basis of the output of the sensor; and self-diagnosis and repair means for determining a cause of the fault and formulating a repair plan on the basis of the knowledge information stored in the knowledge storage means in response to the judgment of the fault, and autonomously performing a fault repairing operation in the unit independently of the other units.

2. A sheet transportation device as set forth in claim 1, wherein the repairing operation to be performed by the self-diagnosis and repair means is based on a controllable self-repairing technique, in which a parameter related to a function damaged by the fault is retrieved from the parameter model knowledge information and an actuator required for changing the value of the parameter is selected, whereby the repairing operation is achieved by controlling the actuator without reconstruction or reconfiguration of the components.

3. A sheet transportation device as set forth in claim 1, further including a system body, which comprises:

a sequence formulation section for formulating a control sequence for the overall sheet transportation system;

a simulation section for simulating the behavior of a sheet on the basis of the formulated control sequence; and an evaluation section for evaluating a simulation result obtained in the simulation section;

wherein, if the control sequence provides an acceptable simulation result, the control sequence is applied to the respective units.

4. A sheet transportation device as set forth in claim 3, wherein the control sequence generated by and applied from the system body is segmented for each unit, and the resulting control sequence segments are applied to the respective units.

5. A sheet transportation device as set forth in claim 3, wherein the units each further comprises translation means for translating the applied control sequence into a unit-executable quantitative sequence on the basis of the knowledge information stored in the knowledge storage means.

6. A sheet transportation device as set forth in claim 4, wherein the units each further comprises translation means for translating the applied control sequence into a unit-executable quantitative sequence on the basis of the knowledge information stored in the knowledge storage means.

* * * * *